US005554962A

United States Patent [19]

Perreira et al.

[11] Patent Number: 5,554,962

[45] Date of Patent: Sep. 10, 1996

[54] DC VACUUM RELAY DEVICE WITH ANGULAR IMPACT BREAK MECHANISM

[75] Inventors: G. Stephen Perreira; Bernard V. Bush, both of Santa Barbara; Richard L. Kutin, Camarillo; Patrick A. Mack, Carpenteria, all of Calif.

[73] Assignee: Kilovac Corporation, Carpinteria, Calif.

[21] Appl. No.: 542,687

[22] Filed: Oct. 13, 1995

Related U.S. Application Data

[63] Continuation of Ser. No. 400,281, Mar. 13, 1995, abandoned, which is a continuation of Ser. No. 275,075, Jul. 13, 1994, abandoned, which is a continuation of Ser. No. 139,604, Oct. 20, 1993, abandoned, which is a continuation of Ser. No. 14,042, Feb. 5, 1993, abandoned, which is a continuation of Ser. No. 897,572, Jun. 11, 1992, abandoned, which is a continuation of Ser. No. 676,968, Mar. 28, 1991, abandoned.

[51] Int. Cl.[6] ..... H01H 51/22

[52] U.S. Cl. ..... 335/78; 335/154

[58] Field of Search ..... 335/78–86, 124, 335/128, 151–4

[56] References Cited

U.S. PATENT DOCUMENTS 3,629,746 5/1970 Delucia ..... 335/170

4,199,740 4/1980 Woods ..... 335/202

4,701,734 10/1987 Nakano et al. ..... 335/128

*Primary Examiner*—Lincoln Donovan

*Attorney, Agent, or Firm*—Kilgannon & Steidl

[57] ABSTRACT

A relay device utilizing an angular "impact break" method to achieve contact break. A rotatable armature is pivotally mounted to one end of the relay while its other end remains separated from the relay pole center by a spring. A separate rotatable actuator, carrying a moving contact, is movably positioned atop the armature and pivoted at the same point where the armature is pivotally mounted. The armature responds to the electromagnetic effects caused by the excitation of the coil, and rotates downward towards the pole center. The actuator rotates along with the armature, due to a spring receptacle on the armature and an overtravel spring between the receptacle and actuator, until the moving contact connected to the actuator contacts the stationary contacts of the relay. After contact, the armature, continues its rotation while the actuator maintains the contact between the moving and stationary contacts. Upon de-energization, the armature rotates upward and away from the pole center and, before making contact with the actuator, acquires kinetic energy which is imparted upon the actuator upon impact with same. Impact force is sufficient to break the previously closed contacts and any welding which occurs between the contacts. The relay device further provides a number of features serving to reduce arcing, puddling and welding.

16 Claims, 8 Drawing Sheets

DC VACUUM RELAY DEVICE WITH ANGULAR IMPACT BREAK MECHANISM

This application is a continuation of application Ser. No. 08/400,281 filed Mar. 3, 1995 which is a continuation of application Ser. No. 08/275,075 filed Jul. 13, 1994 which is a continuation of application Ser. No. 08/139,604 filed Oct. 20, 1993 which is a continuation of application Ser. No. 08/014,042 filed Feb. 5, 1993 which is a continuation of Ser. No. 897,572 filed Jun. 11, 1992, which is a continuation of Ser. No. 676,968 filed Mar. 28, 1991, all abandoned.

BACKGROUND AND DESIGN CONSIDERATIONS OF THE PRESENT INVENTION

Electrical relay devices which operate using electromagnetic principles are a well known and popularly used component employed in many electrical circuit applications. The relay device of the present invention is of the DC contactor type. These relay devices may be operated under high voltage/high current conditions typically having voltages in the 270 Volt DC range. One of the major consequences for relays that operate at these high voltages is that they normally operate in a "hot switching" (switching under load, causing arcing) environment with normal operating currents ranging from 25–1000 amps. The relays also have been known to have an overload interrupt capacity of 100 to 2500 amps and have also been known to have the capability to maintain contact resistances on the order of 5.0–0.1 milliohms.

Relays of the DC contactor type can experience problems in "hot switching" environments in that there is no current zero point in the DC signal (as opposed to that of an AC signal) which can aid in breaking the arc which results from separation of the relay contacts while current is passing through them. Arcing due to contact "bounce" or "make" may cause puddling (contact melting) and possibly the welding together of the relay contacts which is the joining of the contacts together. It is difficult to extinguish these arcs which usually occur during the connection, or making, or the disconnection, or breaking, of the contact surfaces.

Arcing in relays results from the following phenomenon. The contacts may start off in the closed circuit "make" or open circuit "break" position. As they begin to come together or as they begin to separate from one another, the separation between contact surfaces is infinitesimal. Hence, the electric field strength is intense and electrons are accelerated across the gap between the contacts. This leads to an electron avalanche effect resulting in the ionization of particles in the gap. Even if the relay contacts are maintained in a vacuum chamber, arcing may still occur in the absence of air.

In the cases of an air-filled or an evacuated (vacuum) environment, continuous arcing may commence and a great amount of heat may be generated which melts the contact material. The hot, easily ionized material forms a contact plasma (plasma) as the contacts continue to come together, or as they separate. An arc column will then begin to form. This arc column will form from contact plasma in the case of a vacuum environment or from contact plasma along with ionized particles in the case of an air-filled environment. Contact material plasma pressure and/or ionized particle pressure will build up and develop a continuous trail of charged particles between the contacts and thereafter an arc will occur. The arc will finally be extinguished when the contacts come together, or when the contacts fully separate, because the electric field strength between the contacts is not high enough to ionize contact material electrons.

When arcing occurs, a phenomenon known as puddling may occur which describes the actual melting of the contacts surface material. Puddling may cause craters to form on the contact surfaces in those locations where contact material has been melted away or when melted contact material has hardened in a coarse manner. Puddling may further lead to the welding together of the contacts making it difficult to separate them.

Welding refers to the joining of the contacts together either microscopically or more grossly due to the hardening of the melted contact material between the contacts. The occurrence of arcing and its associated puddling or welding of the contacts are most undesirable as they lead to deterioration of the relay contacts, dielectric breakdown, and finally, relay failure.

Aside from the differences already noted between DC contact relay "hot switching" in a vacuum, versus that in air, the following is also to be noted regarding relay "hot switching" in a vacuum. The vacuum has 1) a much greater voltage standoff capability, and 2) significantly reduces plasma formation. Such a reduction in plasma formation is approximately eight orders of magnitude less than the corresponding formation of ionized particles in air-filled chambers. The vacuum also eliminates contaminants which cause increased contact resistance over the operating life of the relay, eliminates air particles which cause oxidation and increased contact resistance, protects against explosions in hazardous environments, and permits the use of hard contact materials without sacrificing low contact resistance. By reducing contact wear, relay life will be increased.

In order to successfully connect relay contacts under load in either a vacuum or in an air-filled environment it is a common occurrence for the contacts to "bounce" during the period of contact closure. It is important at this juncture to note that the making of an electrical connection by connecting two contacts to one another is referred to as contact make or "make" while the disconnecting or separating of these contacts is referred to as contact break or "break".

It is necessary to reduce any arcing, puddling, and/or welding between the contact materials so as to enable the relay contacts to completely be disconnected from each other every time a contact "break" is desired.

In the DC contactor relay design of the present invention, the creation and/or occurrence of ionized particles or contact plasma may be reduced by the elimination of the air such as by employing a vacuum chamber so as to minimize particle ionization, and by utilizing contacts made of a high temperature material which is hard to liquify and ionize. It is also desirable to increase the contact gap quickly upon contact break so as to allow the gap to increase before a sufficient amount of contact plasma and/or ionized particles, which are needed to sustain an arc, forms in the gap. It is important to note that a vacuum also reduces the gap distance required to reach open circuit voltage.

It is also desirable to use additional means to increase the voltage required to sustain an arc. This may be accomplished by using permanent magnets to alter the field between the contacts, thereby making it more difficult for the arc sustaining ionized particles and/or contact plasma to be maintained. Therefore, the arc will be extinguished. Arc chutes, which are well known in the art, and which draw the arc away from its straight path between the contacts, may also be employed to augment this function.

The employment of vacuum technology in relay design also reduces design conflicts and improves relay performance in that large contact cross sectional areas are no longer required. This results in a lower contact resistance per unit area and, therefore, reduced relay size and weight. Further, large contact gaps are not required in a vacuum environment as the vacuum is a far better dielectric than air. This feature also facilitates a reduced relay size.

The use of a vacuum relay device also provides for a faster acting actuator as there is no air drag on the moving contact. Further, a more efficient armature design may be accomplished in the absence of air. These above-mentioned factors also lead to a reduction in both the size and weight of the relay device. The vacuum also facilitates fast arc dissipation as the arcs move 100 times faster in a vacuum than in air. This feature also facilitates a size reduction.

The relay device of the present invention is capable of interrupting high current values at 270 VDC. In order to do so, conflicting design criteria come into play. The relay requires a large contact gap which, in turn, tends to increase the physical size and weight of the relay. Such a relay also requires quick retracting contacts which requires a corresponding decrease in the weight of the contacts.

In the area of reducing power consumption by these relays, it is desirable to minimize the contact resistance. This requires a large contact cross-sectional area which tends to increase contact size and weight and requires a corresponding increase in relay coil size and weight. The minimization of contact resistance also requires a large contact force which requires an increased coil size and weight. Power consumption could also be reduced by minimizing coil heating. This requires a small actuator coil which decreases the size and weight of the coil. Power consumption may further be reduced by allowing puddling to occur. This requires a large actuator force upon the contacts, and therefore, increases the coil size and weight. Lastly, power consumption may be reduced by using smaller parts which allow for the decrease of the size and weight of the relay device and its components.

Relays are basically comprised of a coil which is energized by an electrical current flowing therein. The current flowing therein creates an electromagnetic field which moves an armature in such a manner so as to bring at least two electrical conductors or contacts into connection with one other. As a result, the electrical circuit to be serviced by the conductors is closed and current will flow through the desired circuit. It is at the locations of these contacts or conductors where the aforementioned arcing and its associated problems occur.

Arcing is more severe in DC relays than in AC relays. This is due to the fact that the AC signal varies sinusoidally and periodically over time and usually through a zero value at which point a circuit disconnect or "break" may be effected. The effects of arcing, puddling, and welding, while they may not be totally eliminated, can be reduced by a proper design concept. One way to eliminate or alleviate the problems associated with arcing, puddling, or welding is to provide for a significant amount of force during that instance in time when it is desired to disconnect or separate ("break") the connection between the contacts. This application of force to effect a contact break is known in the art as "impact break". The present invention utilizes an armature shaft in motion prior to the contact break in order to perform this "impact break".

The present invention utilizes the kinetic energy of a moving armature to provide the physical force necessary to "break" the connection between the moving contact and the stationary contact of the relay device by applying the angular force of a rotating armature to an actuator which has attached thereto a moving contact. This is accomplished by using a sudden force of impact which will disconnect the connection between the contacts and break any welding connection which may exist between them. The present invention is a new and improved version of an angular type relay wherein an armature, upon the excitation of a coil and subsequent magnetic field established thereby, rotates in a direction (angularly) towards the pole center of the relay. The driving force is typically the magnetic field which activates movement of the armature. An actuator, carrying the moving contact, is driven by the armature so as to bring the moving contact into contact with the stationary contacts. The armature in the "angular" relay device of the present invention rotates or swings about a pivot, which serves to bring the moving contact into contact with the stationary contacts. When the coil is de-energized, the armature will be driven (or swung) back in the opposite direction, usually by the force of a biased spring mechanism, towards its initial position and the associated actuator will break the contact between the moving and stationary contacts. The further application of this angular force serves to drive the contacts away from each other thereby opening the electrical circuit.

SUMMARY OF THE PRESENT INVENTION

The present invention provides for a relay device of the DC contactor type which utilizes an angular "impact break" method to achieve contact break. The relay device of the present invention, when in an open contact position with its coil de-energized, utilizes a spring element to prevent an armature from contacting the pole center of the relay device, and therefore, closing the contacts prior to energization. More importantly, this spring provides the necessary force to push the armature away from the pole center upon the de-energization of the relay. The armature is pivotally mounted to the relay at one end while its other end remains separated from the pole center by the aforementioned spring. An actuator, carrying a moving contact, is movably mounted atop the armature and is also pivoted to the relay at the same pivot point where the armature is pivotally mounted to same.

As the armature rotates in response to the excitation of the wire coil, and the electromagnetic effects caused thereby, it moves or rotates downwards towards the pole center against the opposing force of the spring. With the actuator structure pivotally connected to the relay and located movably atop the armature, the actuator also rotates along with the armature up to a certain point. The rotating armature will cause the actuator to rotate thereby moving the moving contact, connected to the actuator, until it comes into contact with the stationary contacts of the relay. At this point a contact "make" has been established.

By design, the armature has a greater field of movement than the actuator. Therefore, the armature continues to rotate towards the pole center. Once the actuator's moving contact comes into contact with the stationary contacts, the armature will continue its rotation. As the armature continues to rotate towards the pole center, the activator will maintain the "make" between the moving and stationary contacts. While the actuator will appear to rotate in the opposite direction, relative to the armature, this relative rotation is not an absolute rotation by the activator. Instead, means are provided to allow the angle between the armature and the activator to increase. Thus, the actuator's movement is just a movement relative to the armature. While this is occurring, the armature will continue to rotate downwards towards the pole core to its final resting position. The armature, upon the de-energization of the coil and the subsequent collapse of the magnetic field, will begin to rotate upwards and away from the pole center in the direction opposite its initial rotation. Such rotation will occur before the armature again makes contact with the actuator. As the armature so moves upwards in the opposite direction, which is now in a direction towards the actuator, it picks up kinetic energy which is imparted onto the actuator upon the armature's impact with the actuator. The point of contact between the two components is determined by relay design, which is optimized to keep arcing and its consequences to a minimum.

Upon the impact between the armature and the actuator, a contact "break" occurs and any welding connection that may have existed between the moving and stationary contacts of the relay will be broken. The relay of the present invention is one which yields the most effective geometrical component design and which leads to the most effective relay apparatus for performing contact "make" and contact "break" operations of the angular "impact break" variety.

The present invention provides features which serve to reduce arcing, puddling, and welding by employing cylindrically-shaped stationary contacts the sides of which are designed to connect with the flat surface of the moving contact bar. The moving contact bar also is of a certain length and design such that, along with the cylindrical nature of the stationary contacts, the closely spaced confronting cross-sectional areas between the bar and stationary contacts are minimized and, therefore, arcing due to contact plasma and/or ionized particles is also reduced or minimized and plasma dissipation is enhanced. Further, the stationary contacts are made of higher strength metals such as tungsten or molybdenum which resist melting and puddling. Further, permanent magnets are utilized inside the stationary contacts to disrupt the plasma and/or ionized particle formation, and therefore, extinguish any arcing that occurs. The use of permanent magnets inside the stationary contacts also protects the magnets from damage which could be caused by arcing.

It is an object of the present invention to provide a relay of the DC contactor type for the purpose of connecting and disconnecting electrical contacts which employs an angular "impact break" mechanism to aid in performing an effective contact "break".

It is a further object of the present invention to provide an "impact break" mechanism which is used on a relay apparatus and which employs a swinging armature, or clapper design for effectively translating the motion of the armature, which is activated by an electromagnetic circuit, to the relay actuator assembly.

It is a further object of the present invention to provide an angular "impact break" DC contactor relay which utilizes optimal design geometries and characteristics for design of its contacts so as to minimize or reduce the occurrence of arcing between the contacts on contact "break".

It is a further object of the present invention to provide a relay device which utilizes permanent magnets inside stationary contacts which serves to minimize and extinguish the occurrence of arcing.

These and other objects and advantages of the present invention will become apparent from the following description of the preferred embodiment of the invention made in connection with the following drawings.

DETAILED DESCRIPTION OF THE PREFERRED EMBODIMENT

Figure 1A:
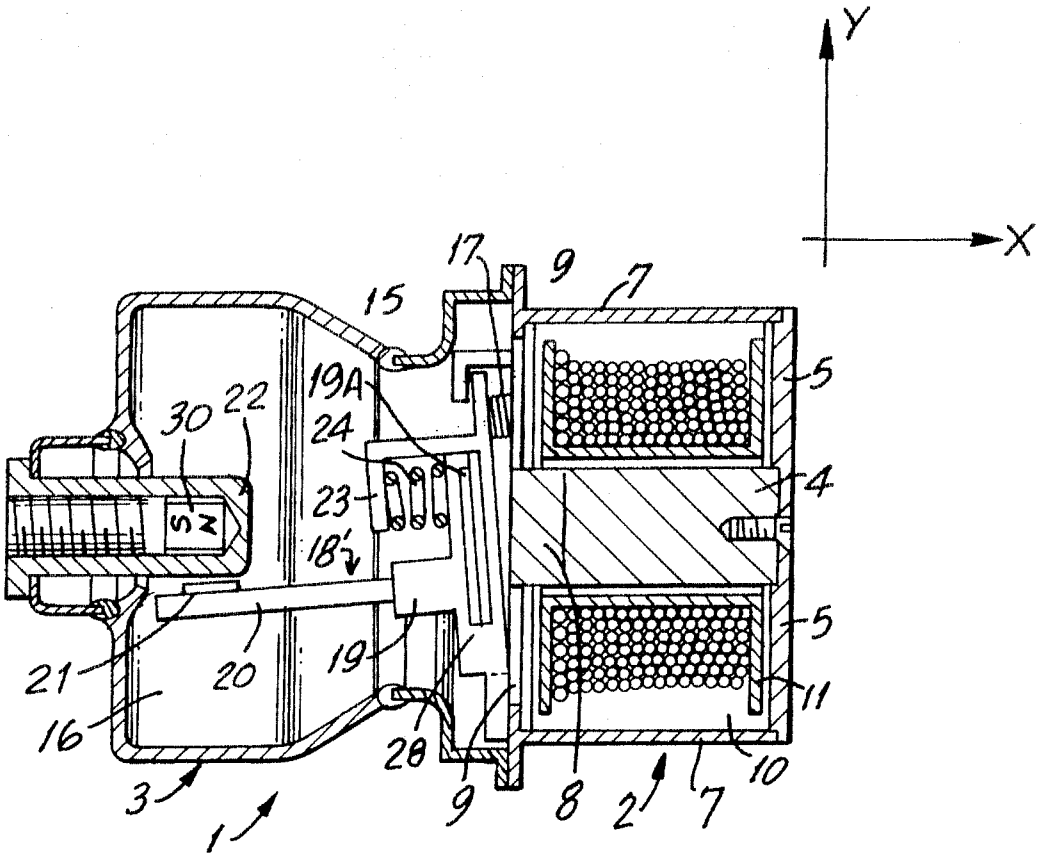
FIG. 1 illustrates a side and top view of the relay device which is the subject of the present invention.
Figure 1B:
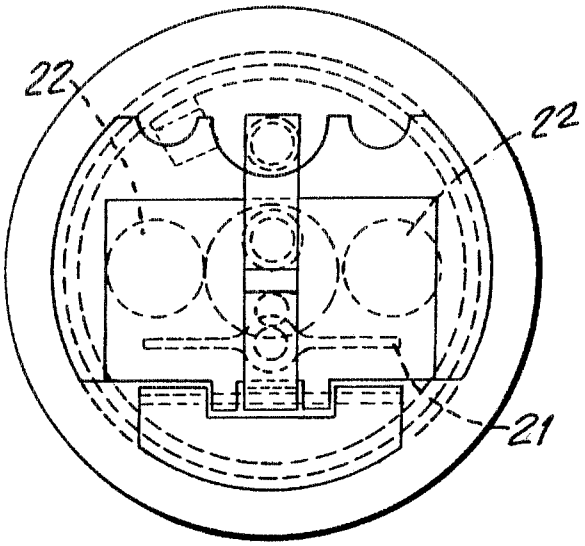

FIG. 1 depicts both side and top views of the relay device which is the subject of the present invention and which is denoted generally by the numeral 1. Relay 1 is comprised of a base region or core assembly 2 and a glass or ceramic structure 3 which encapsulates the remaining relay components. The glass capsule 3 also encapsulates a vacuum chamber 16.

Figure 2:
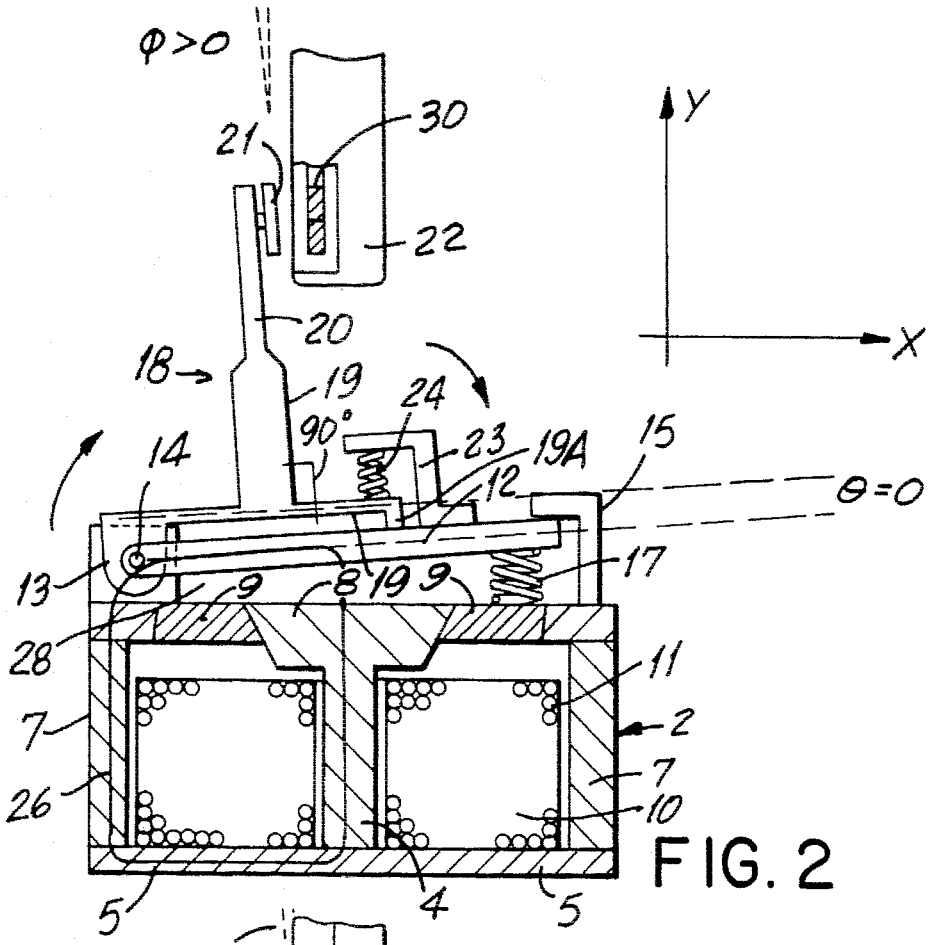
FIG. 2 is a more detailed side view depiction of the relay device of the present invention showing the relay device in an open contact position.

FIG. 2 depicts a more detailed side view of the relay apparatus 1 of FIG. 1. With reference to FIG. 2, the relay 1 is comprised of a base region or core assembly 2, which is further comprised of a core center 4, a core base 5 located at the bottom of the core assembly 2, and a core exterior structure 7, which extends from the core base 5, up the sides of the base structure 2 and partially over the top of the base structure 2, a pole center 8, and a separator 9 which surrounds the pole center 8 and separates the core exterior structure 7 from the pole center 8. As shown in FIG. 2, the core assembly 2 provides for a hollow interior cavity 10 wherein the coil 11 is wound around the core center 4 as shown in FIG. 2. The core assembly 2 and its several component parts with the exclusion of the separator 9 are all composed of a ferromagnetic material. The coil 11 is preferably of the 12 to 18 watts power capacity. As described above, located atop the core assembly 2 and coincidental with the pole center 8, as shown in FIG. 2, is a separator 9.

The separator 9 has a central opening which accommodates the pole center 8 and exposes the pole core 8 to the armature assembly (armature) 12 which is described below. The separator 9 is composed of a non-magnetic material and stretches across the core assembly 2 between the core exterior wall 7 and pole center 8 as shown in FIG. 2.

Located atop the core exterior structure 7 and separator 9 is a pivot structure 13, having pivot pin 14 as shown in FIG. 2. The pivot structure 13 and pivot pin 14 are employed to pivotally mount the armature 12 to the core exterior structure 7 and separator 9. Also located atop the core exterior structure 7 at its opposite end is a stop 15 which is employed to restrict the movement of the armature 12 away from the pole center 8. In this manner, the rotational field of movement of the armature 12, away from the pole center 8, is limited so as to limit the maximum gap between the armature 12 and pole center 8. (It is made to limit the opening gap.) Located adjacent the non-pivoted end of the armature 12, between the armature 12 and the separator 9, is a kick-off spring 17. The kick-off spring 17 serves to provide the force necessary, in the absence of a magnetic field, generated by an energized coil 11, to prevent the armature 12 from traveling towards the pole center 8, and therefore, result in an unwanted contact "make". More importantly, the kick-off spring 17 provides the return force necessary to break the contacts when the coil is de-energized. The kick-off spring 17 should be selected such that its inherent force can be overcome by the magnetic field of the energized coil 11 so as to enable the armature 12 to move towards, and to come as close as possible to, the pole center 8 in order to effectuate a contact "make" when such is desired. The kick-off spring 17 however, should not be excessively strong so as to impede the movement of the armature 12 towards the pole center 8, but must have sufficient strength to provide the impact break force to be discussed below. Located atop, but not connectably mounted to the armature 12, is the actuator assembly (actuator) 18. The actuator 18 is composed of a base member 19, an actuator base stop 19A, an actuator shaft 20, and a movable contact bar 21 which is attached to the actuator shaft 20 as shown in FIG. 2. One end of the actuator base 19 is pivotally connected to the pivot 13 by pivot pin 14. The pivoted ends of the armature 12 and the actuator 18 are not connected or pivoted to each other in any way. They, do, however, share the same pivot location 13 and pivot pin 14 of the relay 1.

Also shown in FIG. 2 are the stationary contacts 22 of the relay 1. While only one stationary contact is shown in FIG. 2, there are two such stationary contacts 22, as seen in the top view of the relay 1 in FIG. 1. These two stationary contacts 22 will be connected to external circuitry so that when the moving contact bar 21 comes into contact with them, the ensuing connection made will close the electrical circuit being serviced by the two stationary contacts 22. The stationary contacts 22, for reasons to be discussed below, are preferably cylindrical. The stationary contacts 22 are also hollow having interior cavities which have placed therein permanent magnets 30, the utilization of which will also be described in more detail below.

The stationary contacts 22 are preferably made of tungsten or molybdenum which are harder metals and which resist melting due to arcing. These design features tend to reduce arcing and its consequences and provide for an optimum electrical connection. The moving contact 21 is specifically chosen so as to further reduce arcing as will be described in further detail below.

The chamber 16 of the relay 1 of FIG. 1, wherein are situated the stationary contacts 22 and the moving contact bar 21, is evacuated so as to establish a vacuum chamber 16 therein. When the movable contact 21 of the actuator 18 comes into contact with the stationary contacts 22, the "make" connection of the relay is complete.

Referring once again to FIG. 2, permanently mounted atop the armature 12 is a spring receptacle 23. Spring receptacle 23 has a slight recess in its inside upper portion so as to facilitate the placement and resting location of and for the top of the over-travel spring 24 therein. The unpivoted end of the actuator base 19, the actuator base stop 19A, while it rests atop the armature 12 when the relay 1 is not energized and, therefore, in the normally open condition, is not permanently connected to the armature 12 for reasons to be described below. The unpivoted end of the actuator base stop 19A is therefore capable of moving upwards and away from the armature 12 as will also be described in more detail below. The actuator base stop 19A provides a means of restricting the movement of the unpivoted end of the actuator assembly base 19, and hence, the actuator 18, away from the armature 12 so as to determine the gap between moving contact 21 and stationary contacts 22.

Located between the unpivoted end of the actuator assembly base 19 and the actuator spring receptacle 23 is an over-travel spring 24 which provides the necessary compression to maintain the actuator moving contact 21 in contact with the stationary contacts 22 of the relay 1 after the connection between these contacts has been made. The over-travel spring 24 must provide sufficient compression to maintain the contact between the movable contact 21 and the stationary contacts 22 while the armature 12 continues its rotational movement after the contacts have already come together to establish a contact "make". The over-travel spring 24 also facilitates the continued rotation by the armature 12 while allowing for the maintenance of the contact "make" between the moving contact 21 of the actuator 18 and the stationary contacts 22. Over-travel spring 24 allows a "relational rotation" of the actuator 18, which is in a direction opposite (relative) to the rotation of the armature 12 after contact "make" has occurred. It should be noted that this movement by the actuator 18 is not an absolute rotation but is only a movement relative to the armature 12 so as to enable the armature 12 to continue its rotation while the contact "make" is sustained.

The over-travel spring 24 should also be of sufficient pre-load compressive force so as to maintain the unpivoted end of the actuator assembly base 19 and actuator base stop 19A against the armature 12 before the moving contact 21 and stationary contacts 22 come into contact with one another. However, the stiffness of the over-travel spring 24 should not be excessive as this may impede the movement of the armature 12 after contact "make". With the structure of the relay 1 of the present invention described in detail as above, the operation of the present invention will now be described.

Referring once again to FIG. 2, the relay 1 of the present invention is shown in its open contact or "break" condition wherein the electrical circuit to be serviced is open. In this open position, the kick-off spring 17 maintains the armature 12 against the stop 15. With the armature 12 in this relay open position as shown, the actuator 18 has its unpivoted end, the actuator base stop 19A, resting against the armature 12 as shown. This arrangement provides for the actuator 18 to be oriented at an angle $\phi$ (phi) away from the relay vertical line and away from the stationary contacts 22.

As the coil 11, which is wound around the core center 4, becomes energized by the flow of electrical current there-through a magnetic flux field 26 is created as shown in FIG. 2. As is well known in the field of electromagnetic relays, once the magnetic flux 26 is created in the electromagnetic relay circuit, such as this one of the present invention, the armature 12 will begin to rotate or swing downwards and travel towards the magnetized pole center 8 of the relay 1.

Thus, the magnetic flux 26 is the driving force of the armature 12 and thus of the operation of the relay 1. The magnetic flux 26, created in the present invention, comprises a magnetic flux loop traversing the loop consisting of: the core center 4, the pole center 8, the air gap 28 (which exists between the pole center 8 and the armature 12), the armature assembly 12, the pivot location 13 and pivot pin 14, the core exterior structure 7, the core base 5, and returning to the core center 4. Once the magnetic field 26 is created, the armature 12 begins to rotate upon the attraction of the armature 12, downwards towards the pole center 8, overcoming the force of the kick-off spring 17 so as to close the gap 28 between the armature 12 and the pole center 8. Simply stated, the magnetic effect of the electrical current flowing through the energized coil 11 causes the armature 12 to rotate towards the pole center 8, which will ultimately activate the relay 1.

In the normally open condition of FIG. 2, the actuator shaft 20 remains at a right angle away from the armature 12 as shown. Also as shown in FIG. 2, the center line of the actuator base 19 and the center line of the armature 12 lie in the same plane with one another and therefore, the angle θ (theta) between them is 0°. As the armature 12 rotates downward towards the pole center 8 upon the energization or activation of the coil 11, the actuator shaft 20 continues to remain at a right angle to the armature 12. During this movement, the actuator's unpivoted base stop 19A is situated against the armature 12 as shown in FIG. 2. However, the range of rotation of the armature 12, by design, is greater than that of the actuator 18 in the direction of travel toward the pole center 8. As a result, as the armature 12 continues its downward rotation towards the pole center 8, the moving contact 21 of the actuator 18 will come into contact with the stationary contacts 22 to create a contact make or "make" condition as is illustrated in FIG. 3.

Figure 3:
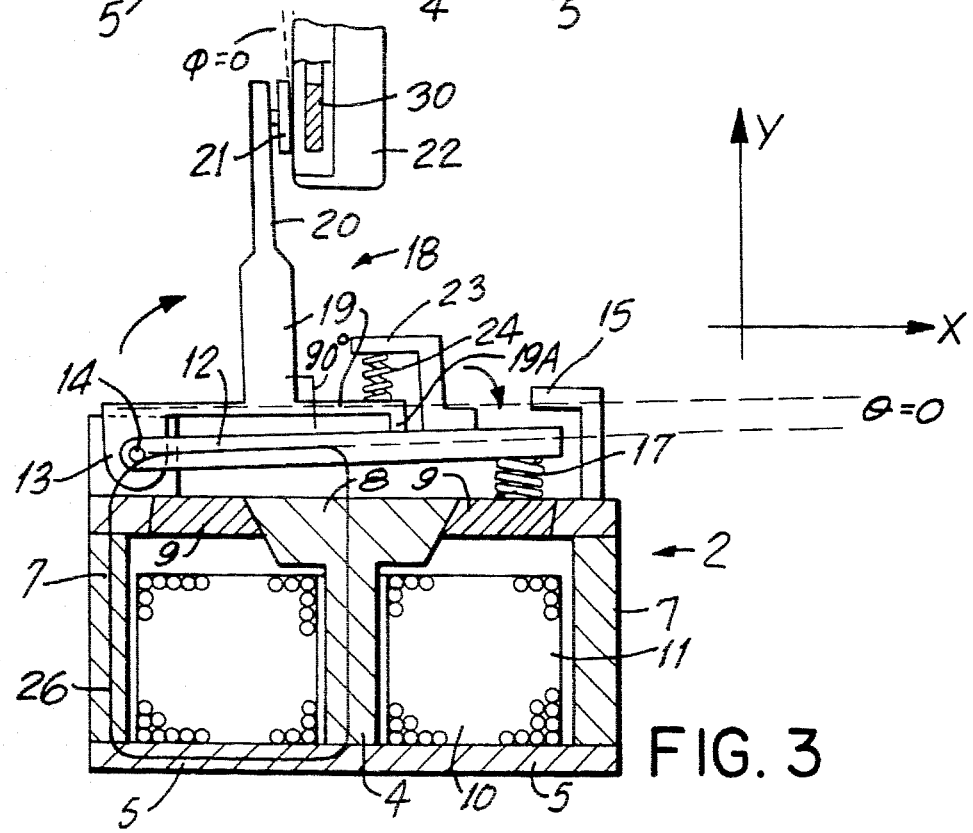
FIG. 3 is a more detailed side view depiction of the relay device of the present invention in an intermediate position wherein the moving contact has just come into contact with the stationary contacts.

FIG. 3 is a side view of the present invention which illustrates this intermediate (initial "make") state of the relay 1 when the contacts 21 and 22 first come into contact with one another. As can be seen in FIG. 3, contact "make" occurs before the armature 12 reaches its final resting place adjacent to the pole center 8. At this moment in the operation of relay 1, the continued movement of the actuator 18 and/or the armature 12 would be impeded or obstructed were it not for the over-travel spring 24. If the actuator 18 were rigidly connected to the armature 12, the movement of the armature 12 would be obstructed by the contact of the moving contact 21 with the stationary contact 22. In the alternative, the continuous rotation of the armature 12 could damage the actuator 18 or the stationary contacts 22. Since the armature 12 is initially responsible for the rotation of the actuator 18 towards the stationary contacts 22, provision must be made to allow for the continued and unobstructed rotation of the armature 12 after initial contact "make" occurs while maintaining the contact "make" between the stationary contacts 22 and the moving contact 21. The present invention solves this design problem in the following manner.

Figure 4:
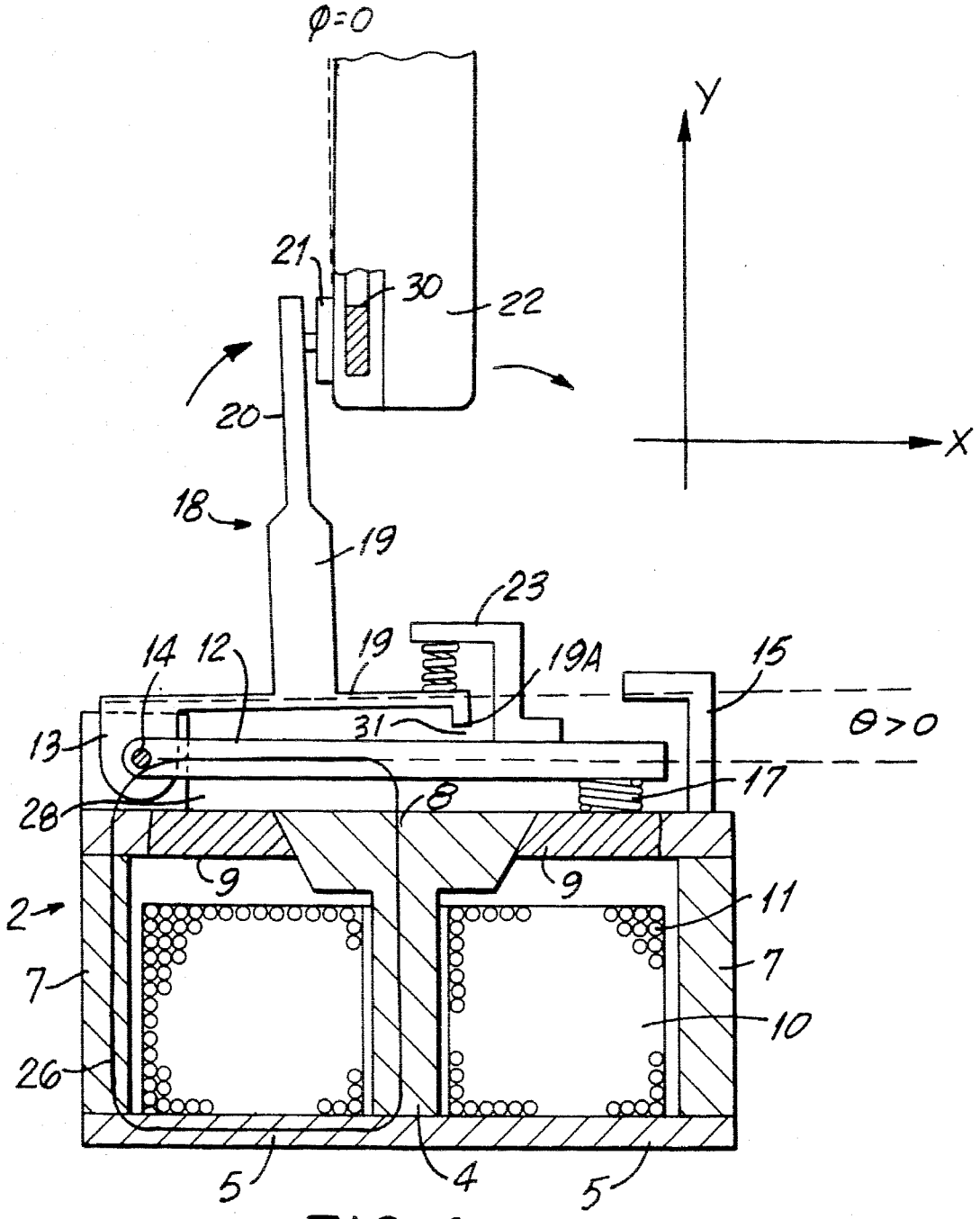
FIG. 4 is a side view depiction of the relay device in a closed contact condition further illustrating the angular relationship between the armature and the actuator in the closed condition.

Referring now to FIG. 4, once the actuator 18 and its moving contact 21 have come into contact with the stationary contacts 22, the armature 12 will continue in its downward rotation and the actuator 18 will begin a relative movement which has the effect of it rotating backwards in the opposite direction relative to the rotation of the armature 12. It should be noted that the movement by the actuator 18 is not an absolute rotation but is only a movement relative to the rotating armature 12. By this, it is meant that no longer will the center lines of the armature 12 and the actuator assembly base 19 lie in the same plane with one another. Hence, the angle θ (theta) will no longer be equal to 0°. This movement by the actuator 18 relative to the armature 12 allows for the continued unobstructed rotation of the armature 12 as it rotates downward towards the pole center 8. During this subsequent armature 12 rotation, the moving contact 21 and the actuator 18 are still at rest relative to the stationary contacts 22 and the pole center 8, therefore maintaining a contact "make" condition. The continued rotation of the armature 12 is facilitated by the design scheme of having one end of the actuator base 19 pivotally mounted to the pole center 8 at pivot location 13 and pivot pin 14 as shown in FIG. 4, while the opposite end of the actuator base stop 19A is unconnected to the armature 12. It is at this point that one can appreciate the utility of the over-travel spring 24 which provides sufficient compressive force between the moving contact 21 and the stationary contacts 22 so as to allow continued armature 12 rotation while maintaining the contact "make".

The over-travel spring 24 therefore is vital in allowing the armature 12 to continue its downward rotation toward the pole center 8 uninterrupted while the actuator 18 "moves" relative (but not absolutely) to the rotation of the armature 12. It is the over-travel spring 24 which is the means by which the angle θ (theta), between the center lines of the actuator assembly base 19 and the armature 12, is allowed to increase to thus facilitate this above described activity. As the armature 12 continues its downward rotation, the actuator assembly base 19 adjacent to the over-travel spring 24, compresses the over-travel spring 24 as shown in FIG. 4. As the armature 12 continues to rotate towards the pole center 8 as in FIG. 4, it is also noted that the center line of the actuator base 19 and the center line of the armature 12 are no longer in the same plane with respect to one another, but rather are now rotated at an angle θ (theta), which is greater than 0°, relative to one other As can be seen, the angle θ (theta) must exist between the center lines of the actuator base 19 and the armature 12 in order for the armature 12 to reach its final resting position adjacent to the pole center 8 while maintaining contact "make".

The over-travel spring 24 must be of sufficient stiffness to maintain the "make" while moving with the armature 12. During this "make" condition, as described above, arcing may occur due to the "bouncing" of the moving contact 21 and stationary contacts 22 with each other upon "make". Also, as described earlier, puddling, or the melting of the contact surfaces, and the possible welding thereof, may result from this arcing, even in the evacuated chamber 16 of the present invention.

Arcing will occur as the "hot switching" may cause the contact surfaces to liquify, which would further lead to the formation of plasma in the gap between the contacts. This will contribute to the creation of plasma which will result in arcing. These arcs may cause the contacts to become welded together either microscopically or in a grosser fashion. When this occurs, the unique design of the present invention will be capable of effecting a complete circuit "break" condition by utilizing an angular "impact break" method. The manner by which the present invention performs this angular "impact break" operation will be described as follows with reference to FIGS. 5 through 7.

Figure 5:
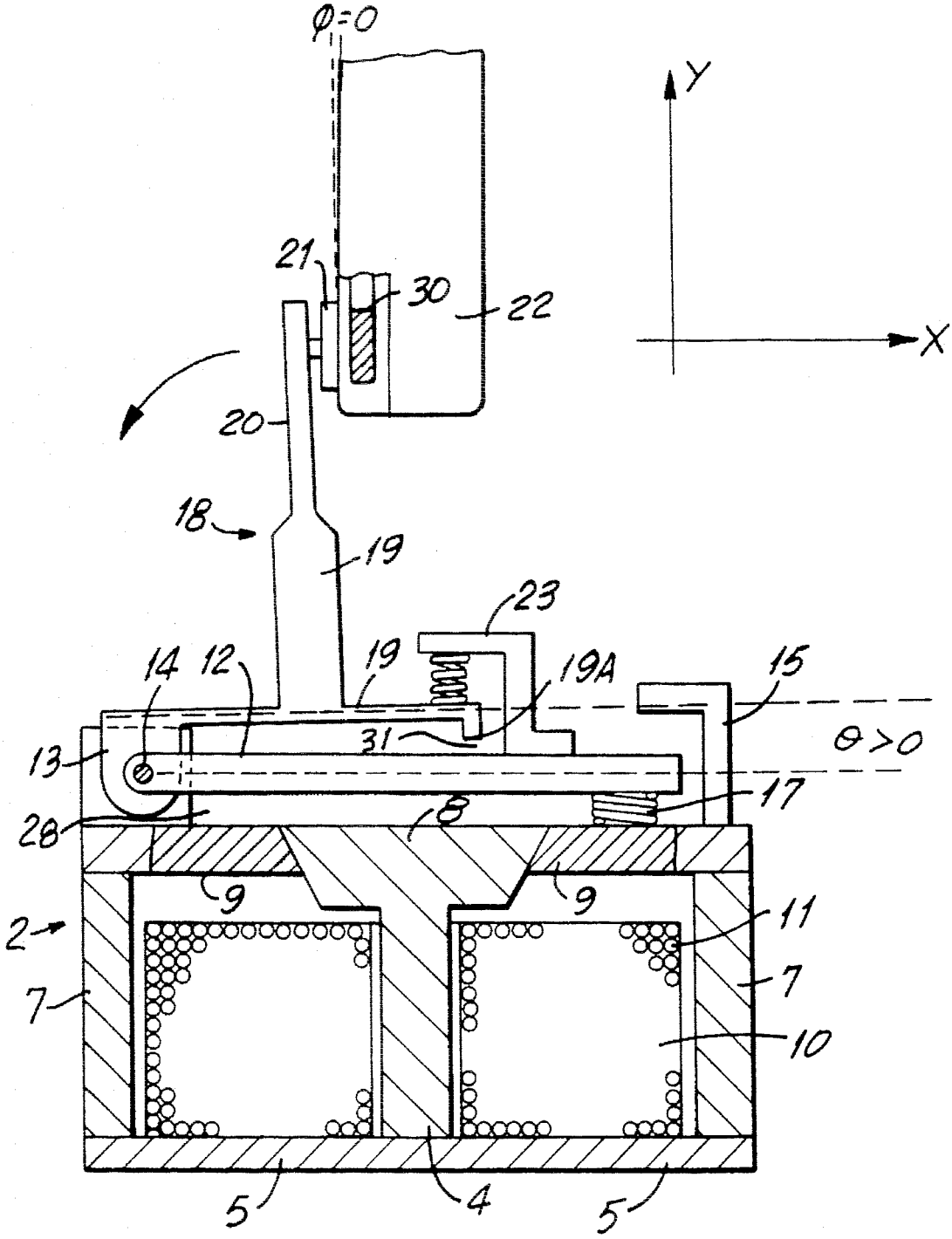
FIG. 5 is a side view depiction of the relay device of the present invention just prior to the relay being de-energized and the onset of the armature rotating away from the relay base which initiates the effectuation of a contact break.

Referring to FIG. 5, which illustrates the final "make" position, when the coil 11 is de-energized, the magnetic field 26 will collapse, at which time the magnetic field which caused the armature 12 to rotate towards the pole center 8 ceases to exist. As a result, the absence of the magnetic field allows the kick-off spring 17 to rotate the armature 12 upwards and away from the pole center 8, as shown in FIG. 5. At this instant in time, the force of the kick-off spring 17 will be the sole force acting on the armature 12. Note that in FIG. 5 there is a gap 31 in between the top of the armature 12 and the bottom of the actuator base stop 19A which had earlier been described as having been created as a result of the continued rotation of the armature 12 taken in conjunction with the activity of the over-travel spring 24 and the actuator 18.

Figure 6:
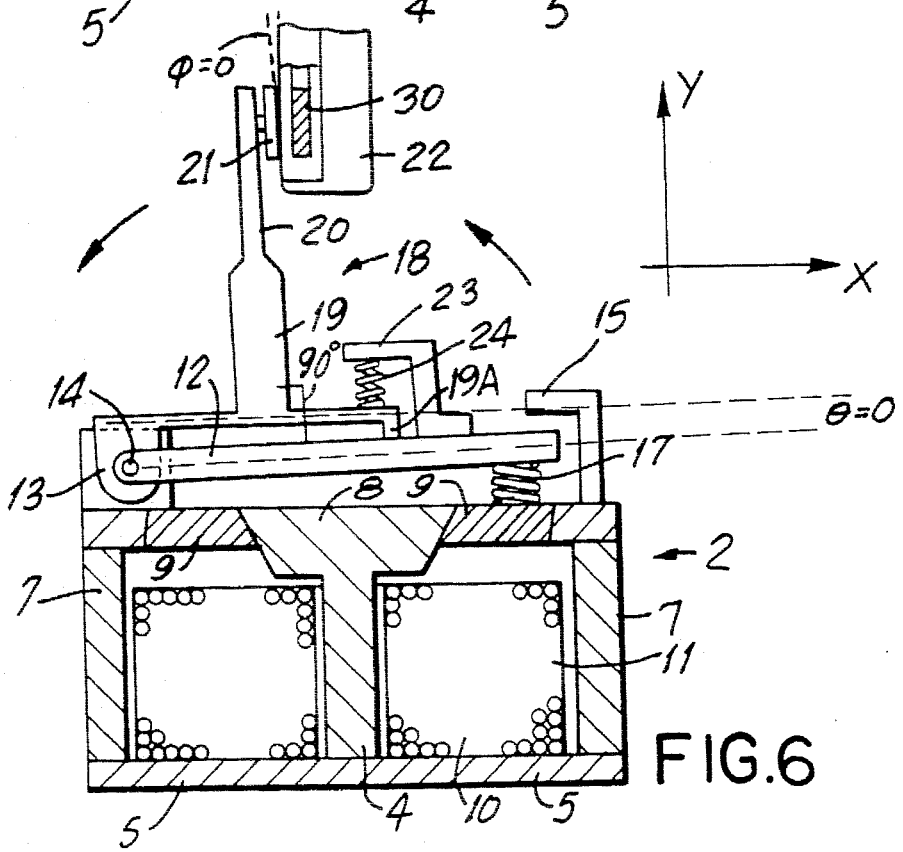
FIG. 6 is a side view depiction of the relay device of the present invention in its intermediate, closed contact, position just prior to contact break.

Since there is no contact at this time between the armature 12 and the actuator base stop 19A, the armature 12 will begin to rotate prior to its coming into contact with the actuator base stop 19A. As the armature 12 rotates upwards and away from the pole center 8, it picks up angular momentum, and kinetic energy. Also, the angle θ (theta) between the center line of the actuator assembly base 19 and the armature 12 begins to decrease towards 0°, which action in turn relaxes the over-travel spring 24 which will then begin to expand towards its initial compressive preload condition. At the point where the armature 12 comes into contact with the bottom of the actuator base stop 19A (i.e. when the angle θ between the center lines of the armature 12 and the actuator assembly base 19 returns to 0°), the armature 12 will strike the bottom of the actuator base stop 19A, as shown in FIG. 6, thereby imparting and transferring a portion of its own kinetic energy to the actuator 18. This is the angular "impact break" which the present invention utilizes to perform a contact "break." The angular nature of this "impact break" feature results from the rotation or swinging of the armature 12 about its pivot location 13 and pivot pin 14. This transfer of kinetic energy takes place due to the well known theory of conservation of momentum. The transfer of the kinetic energy from the armature 12 to the actuator base stop 19A and the actuator 18 will be sufficient to break any connection between the contacts including any welding which may have occurred between the contact surfaces. After impact break has occurred, the actuator base stop 19A and the actuator 18 remain in contact with the armature 12, aided by the over-travel spring 24, so that the continued rotation of the armature 12 upwards and away from the pole center 8 will ensure that the movable contact 21 of the actuator 18 will be translated far enough away from the stationary contacts 22 so as to insure a complete "break" of any contact connection. This will result in an open circuit condition as illustrated in FIG. 7.

Figure 7:
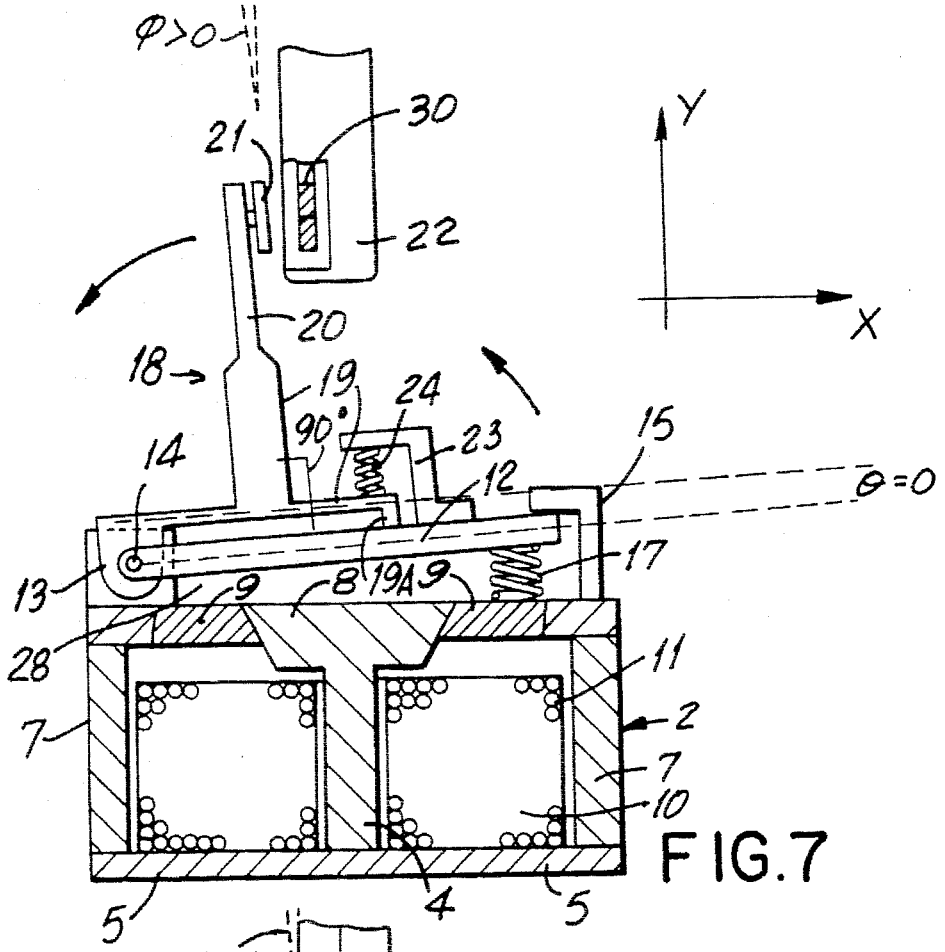
FIG. 7 is a side view depiction of a relay device in its contact open position, illustrating the final stage of the contact break position.

The armature 12 will continue its rotation upwards and away from the pole center 8 until it comes into contact with, and is stopped by, the stop 15 as shown in FIG. 7. Contact between the armature 12 and the actuator base stop 19A and the actuator 18 will be maintained by the over-travel spring 24. At this point, with the over-travel spring 24 extended and the angle θ (theta) between the center lines of the armature 12 and the actuator assembly base 19 equal to 0°, the relay will be in its initial open condition as was previously illustrated in FIG. 2. As shown in FIG. 7, when the armature 12 and actuator 18 finally come to rest, the actuator shaft 20 will once again be at an angle of ϕ (phi) from the relay system vertical line and away from the stationary contacts 22.

The relay thereafter remains in this open condition state as shown in FIG. 7 until the coil 11 is once again energized.

In order to properly illustrate the design features of the present invention, the critical points in, and methods of, design of the relay 1 will be described so as to illustrate the many benefits of this embodiment over its alternatives.

From the above description of the preferred embodiment of the present invention, it can be noted that there are two critical points of travel of the actuator 18 which connects "makes" or disconnects "breaks" the electrical contacts 21 and 22 in the relay 1. The first critical point is that point at which the actuator 18 and the moving contact 21 comes to rest after making contact with the stationary contact 22, as illustrated in FIG. 3. The second critical point is the point at which the moving contact 21 of the actuator 18 just becomes separated from the stationary contacts 22 as shown in FIG. 6. While physically these two points are at the same location (see FIG. 3 and FIG. 6), the forces which act upon the various system components at these two different times are very different.

It is critical to have normal forces (perpendicularly directed) incident upon the surfaces of the stationary contacts 22 upon the "make". Also, forces must be acting normal to the moving contact 21 upon "break". This normal force which effects "break" is directly applied to the actuator assembly base 19, and therefore, it is an indirect force which is normal to the surface of the moving contact 21.

When the moving contact 21, attached to the actuator 18, comes into contact with the stationary contacts 22 as shown in FIG. 3, thus completing the "make" condition, it is critical that the moving contact 21 meet or impact the surface of the stationary contacts 22 with a force normal to the surface of the stationary contacts 22. Also, the surfaces should meet flush against one another so as to prevent "wiping" from occurring. "Wiping" is the vertical motion of the contact surfaces parallel to one another prior to their settling down to complete a "make" with respect to one another. "Wiping" also increases the incidence of arcing which can lead to puddling and welding between contacts.

The arcing, puddling, and welding, as described previously, occurs because of the bouncing motion of the contacts when they first come into contact with one another. This arcing, puddling, and welding activity may be increased if there is excess motion of the surfaces of the contacts parallel to one another.

Figure 8:
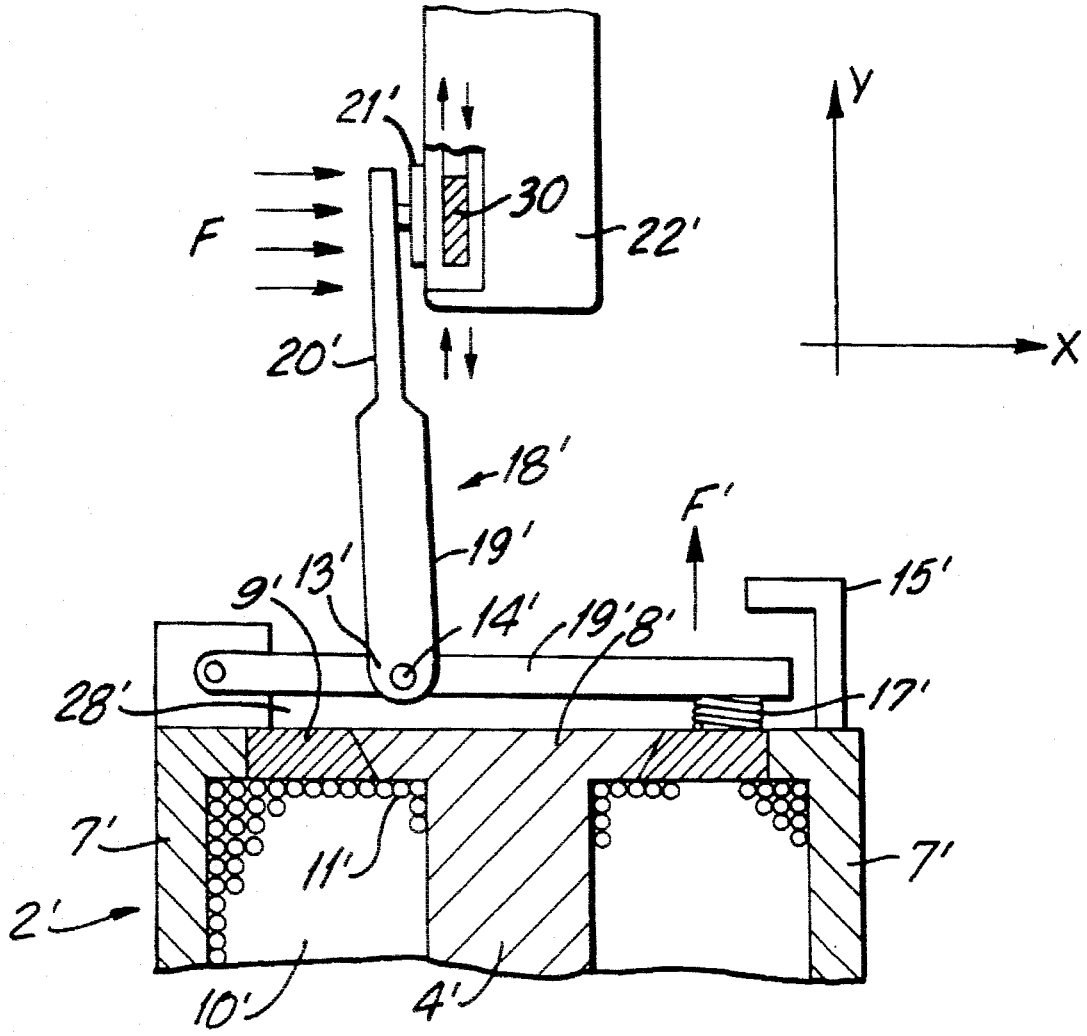
FIG. 8 is a side view depiction of an alternate relay device, not of the present invention, employed to illustrate the shortfalls inherent in such a design configuration, as opposed to that of the present invention.

As illustrated in FIG. 8, this normal force F is provided by the moving contact 21 as it exerts a force normally incident upon the surfaces of the stationary contacts 22. The importance of these two contacts meeting flush against one another with the normal force exerted onto the surface of the stationary contacts 22 is such that a contact "make" will occur without "wiping" between contacts.

When the stationary contacts 22 and the moving contact 21 are to be disconnected, described as contact "break" a force normal to the contact surface of the moving contact 21 and to the actuator shaft 20 is required in order to "break" the connection between the contacts and any welding that may have occurred between them. As described above the "break" occurs when the armature 12 strikes the bottom of the actuator base stop 19A as was shown in FIG. 6 as the armature 12 rotated upwards and away from the pole center 8. The normal force described to be required to achieve contact "break" is necessary to produce a forceful and sudden separation between the surfaces of the moving contact 21 and the stationary contacts 22, and is obtained by utilizing the horizontal component of the force exerted by the upwardly rotating armature 12 as it strikes the bottom of the actuator base stop 19A. This forceful and sudden application of a force in a direction normal to the contact surface of the moving contact 21 is essential in order to minimize "wiping" between the contact surfaces and any arcing which may occur upon the interruption of the current which is flowing through the contacts at the time of "break". This horizontal force is also necessary in order to effectively break any welding which may exist between the contact surfaces.

Hence, it becomes necessary to have a geometrical arrangement which functions to provide for the generation and utilization of the most optimum normal forces against, or in the direction of the contact surfaces of the stationary contacts 22 when a contact "make" occurs, and a normal force against the moving contact 21 and the actuator shaft 20 when contact "break" occurs. Therefore, it becomes necessary that the armature 12 and actuator 18 be designed in a configuration which fits within certain parameters.

The design criteria to provide for the necessary normal forces optimum for contact "make" and contact "break" can be described in relation to FIG. 3 which is a depiction of the relay 1 of the present invention in the closed contact "make" position. On contact "make", the optimum design position dictates that the movable contact 21 of the actuator 18 be positioned at the top of its arc of travel at the time of its coming into contact with the stationary contacts 22. At its pinnacle, or top-of-the-arc of movement, almost all of the momentum of the moving contact 21, and therefore, the force it exerts, will be directed in the horizontal direction, parallel to the X-axis of the system. The surfaces of the stationary contacts 22 and the moving contact 21 are designed to be parallel to the system vertical, or Y-axis, at this point so that all of the force or momentum directed by the moving contact 21 will be in the horizontal direction. Therefore, this design provides for the maximum horizontal component force to be incident on the stationary contacts 22 when "make" occurs. Since the stationary contacts 22 and their surfaces are parallel to the Y-axis, the motion of the moving contact 21 in the direction of the X-axis will produce a force normal to the surfaces of the stationary contacts 22. This normal force incident on the surface of the stationary contacts 22 is required to produce the maximum contact force to "make" the connection between the contacts in order to minimize "bouncing", and to further do so with the lowest amount of contact resistance possible. The achievement of the minimization of "bouncing" and the lowest amount of contact resistance are key performance parameters in any efficient electrical relay device.

Upon contact disconnect or "break" the exciting force originates with the upwards (Y direction) movement of the armature 12 as it begins to rotate upwards and away from the pole center 8 as shown in FIG. 5. This exciting force, described as a lift-off force, is projected in the positive Y (+Y) direction as shown, and therefore, is produced in a direction 90° from the direction of the force inherent on the surface of the stationary contacts 22 (which is not in the present invention) if such were in some way connected to the armature 12. If the armature 12 were in fact connected to the stationary contacts 22 (which they are not in the present invention), the vertical component of the lift-off force would result in a force which is parallel to the surfaces of the moving and stationary contacts 21 and 22, respectively. This activity would produce little or no force along the X-axis in the direction necessary to force the moving contact 21 away from the stationary contacts 22 and it would further cause the undesired "wiping" to occur between the contact surfaces.

Therefore, it can be seen with reference to FIG. 5 that a tradeoff must be made to allow for the successful operation of the mechanism for achieving both contact "make" and contact "break" in the most optimum fashion. The design of the present invention has achieved this tradeoff requirement in the most effective manner by separating the armature 12 from the actuator base stop 19A in the closed contact position and allowing the armature 12 to obtain a running start in its direction towards, and its striking of, the actuator base stop 19A at which time it has sufficient momentum and kinetic energy so as to provide a sufficient force component in the X-direction, normal to the surface of the moving contact 21, to effect a contact "break".

There are three possible configurations which can be employed in order to provide for a relay device with similarities to the present invention. However, only the design of the present invention will provide for the optimal relay device which will achieve all of the sought after objectives. These alternatives will be discussed below in order to more fully expose the utility of the design of the present invention.

The three possible configurations which can be used are as follows:

1) The pivot of the actuator is located on the armature itself; or
2) The pivot of the actuator is located beyond the pivot of the armature; or
3) The design of the present invention wherein the pivot of the actuator is located at the same pivot point as the pivot of the armature.

These design alternatives will be discussed in turn.

1. Pivot of Actuator Located on the Armature Itself.

Referring to FIG. 8 a relay, not of the design of the present invention, is shown. The components employed in this embodiment are similar or analogous to their counterparts in the present invention, and as such, they will be so numbered with primed numerals (i.e., 1', 2', etc.) to reflect such correspondence to components of the present invention. However, the relay 1' of FIG. 8 has its actuator 18' pivoted to the armature 12' and not to the core exterior structure 7' as was the case in the present invention.

The design of FIG. 8 is undesirable because the exciting force and motion of the armature 12' upon liftoff from the pole center 8' will produce a very large vertical component F' (in the Y direction) as shown, which will produce the undesired "wiping" motion described earlier which will increase the amount of arcing, puddling, and welding between moving contact 21' and stationary contacts 22'. The placing of the pivot 13' of the actuator 18' on the armature 12' also causes the linkage between the two relay components to bind up when the actuator 18' and moving contact 21' attempt to move away from the stationary contacts 22' in order to effect a contact "break".

There are two methods which the relay may employ which can "break" the connection of the surfaces of the stationary contacts 22' and moving contact 21'. Both of these methods, however, have their shortfalls and are therefore undesirable.

The first method is to provide a kick-off spring 17' which will provide sufficient force to break the connection between the contacts and any welding which may occur between them. This method, however, is very inefficient because it would require a very large force to break the connection and any welding which may have occurred between the contacts in order to separate them.

This design would require a large kick-off spring 17' which in turn would require an unnecessarily large relay 1' which would be necessary in order to provide the large electromagnetic circuitry and coil (not shown) necessary to compress the large kick-off spring 17' for proper relay operation.

A second method would be to utilize an actuator 18' which would be permitted to articulate, or separate into joints, while the welding holds the contact surfaces of the stationary contacts 22' and the moving contact 21' rigidly together. In this manner, the armature 12' would be temporarily detached from the actuator 18' so that it would be allowed to gain momentum and kinetic energy as it rotates upwards and away from the pole center 8'. This kinetic energy in the armature 12' can then be employed to break the contact, and any welding between the moving contact 21' and stationary contacts 22' through a hard "impact break" upon the actuator 18'.

While the second method is far more efficient than the first method, it is limited by the proper positioning of the actuator pivot 13' and pivot pin 14' in order to permit the articulation of the actuator 18' while the armature 12' is moving. The placing of the actuator pivot 13' and pivot pin 14' on the armature 12' itself does not practically allow for this articulation of the actuator 18', and therefore, cannot be considered as a viable alternative for the following reasons:

Once the welding between the surface of the stationary contacts 22' and the moving contact 21' occurs, there is a fixed connection between the armature 12' and the stationary contacts 22', through the actuator 18'. This is the result of the actuator 18' being pinned or pivoted at one end to the armature 12' as shown in FIG. 8 at pivot 13' by pivot pin 14', and welded at its other end to the stationary contacts 22' by way of moving contact 21'. When the kick-off spring 17' pushes against the armature 12', after the relay 1' has been de-energized, trying to force the armature 12' upwards, the kick-off spring 17' will be unable to move the armature 12' until it either (1) breaks the weld between the contacts 21' and 22', or (2) causes the pivoting pin 14' to break, or (3) physically deforms the actuator 18'.

Therefore, these configurations cannot be utilized in an impact break method of design because the kick-off spring 17' and the armature 12' will be prevented from moving because of the welded contacts 21' and 22'.

The present invention overcomes the above described shortfalls by placing the actuator 18 on a fixed pivot point 13 with pivot pin 14 as shown in FIG. 2 which results in the actuator 18 not being rigidly linked to the armature 12. Therefore, the actuator 18 can move relative to the armature 12, while the armature 12 itself rotates. The subsequent rotation by the armature 12 in the opposite direction upon coil de-energization is then followed by the angular "impact break" on the bottom of the actuator base stop 19A, and the transfer of kinetic energy thereto, which allows the actuator 18 to "break" the connection and any welding which may have occurred between the surfaces of the stationary contacts 22 and the moving contact 21 as described above.

For the above described reasons, the first design alternative, wherein the actuator is pivoted to the armature, is undesirable.

2. Actuator Pivot Point Outside the Armature Pivot.

While this alternative design configuration (not shown) may place the actuator pivot outside of the pivot point of the armature and away from the center of the relay device, this configuration would result in a very inefficient relay design. Such a design configuration would place the actuator outside of the relay envelope thus requiring a relay of increased size to accommodate such placement of the actuator assembly pivot. This second alternative design configuration is unacceptable especially where size and weight are critical design parameters.

The optimum position for the pivot of the actuator is as close as possible to the inside edge of the relay so that no gap will exist between the pivot point of the actuator and the pivot point of the armature. The present invention provides just such a design configuration and therefore provides for a relay design without the undesirable increased size requirements.

3. Actuator and Armature Pivoted at the Same Pivot Location—The Present Invention.

The present invention provides a relay design wherein the actuator 18 and the armature 12 are pivoted at the same pivot location 13 with pivot pin 14 as shown in FIG. 2. This design, as is readily apparent in view of the previous two design alternatives, provides for the optimum relay design and thus, fulfills the objectives of the present invention. Thus, it is crucial to the present invention that the armature 12 and actuator 18 be pivoted at the same pivot point so as to provide for a relay device of the present invention which avoids the shortcomings of the previously described alternatives (i.e., 1) actuator pivot on the armature, and 2) actuator pivoted at a point outside the pivot point of the armature).

The present invention also utilizes design techniques which reduce arcing and its deteriorative effects. These design techniques include using cylindrically-shaped stationary contacts 22, utilizing hard metals such as tungsten or molybdenum in the stationary contacts 22 so as to provide for reduced melting of the stationary contact surfaces, utilizing a moving contact 21 having a length and shape which further reduces closely spaced confronting cross-sectional surface areas between the moving and stationary contacts, and utilizing permanent magnets 30 located inside the stationary contacts 22 to extinguish any arc columns which may form between the contacts. These design techniques will be described below.

Figure 9:
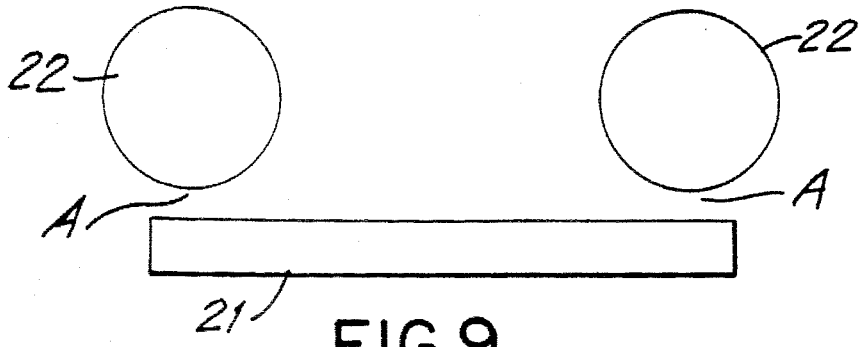
FIG. 9 illustrates a top view of the design geometry of the configuration of the moving contact and stationary contacts which is employed to provide for the optimal contact and closely confronting surface areas.

FIG. 9 illustrates a top view of the preferred structure for the stationary contacts 22 and the moving contact 21 in an open contact "break" condition in the vacuum chamber 16. The stationary contacts 22 are preferably cylinders with slightly rounded ends as shown in FIG. 1 but the rounding of the edges is not required. Each stationary contact 22 makes contact with the moving contact 21 at terminal region A, which is essentially a line contact parallel to the axis of the cylinder at the point of tangency. By providing for the terminal region A on the stationary contacts 22 and for a portion of moving contact 21 to contact with the terminal region A of the stationary contacts 22, contact surface area is minimized and less arcing will occur upon "make" and "break". It should be noted that if the surface contact area is too small, the contacts may fail to handle the electrical connection properly. If however, the contact surface is too large, the geometry of the stationary contact 22 and the moving contact 21 would too closely approach that of two flat plates, and therefore, more arcing may be produced and trapped between the contacts.

Figure 10A:
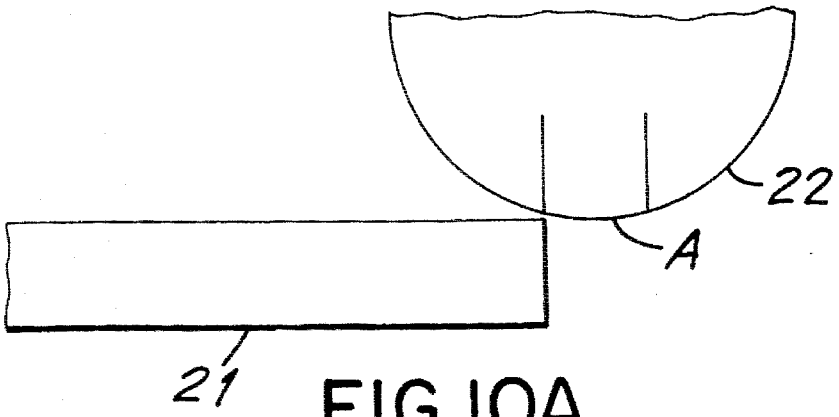
FIGS. 10A, and 10C illustrate the possible design alternatives for effecting a contact connection between the moving contact and the stationary contacts, of which one is the preferred design of the present invention.
Figure 10C:
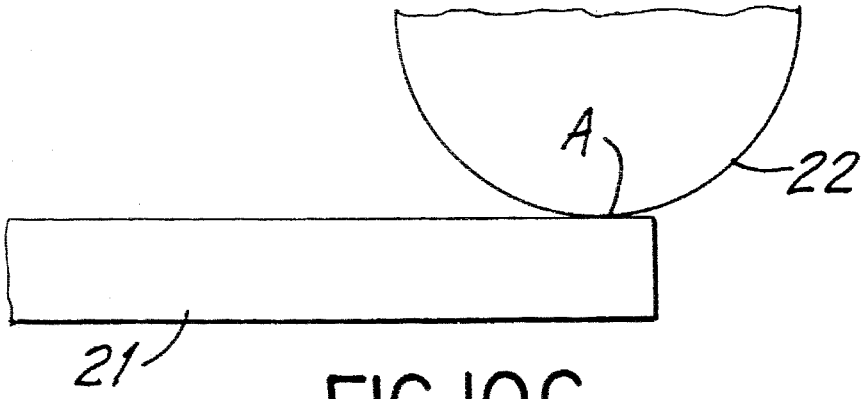
Figure 10B:
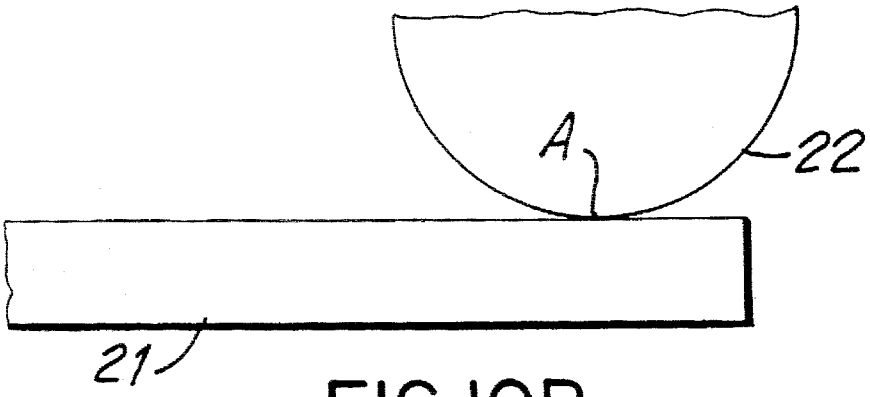

In order to reduce arcing and its consequences, another vital design feature concerns itself with the amount of distance by which the moving contact bar 21 overlaps the terminal region A of the stationary contacts 22. With reference to FIG. 10, which is a top view of the moving contact 21/stationary contact 22 arrangement, the moving contact bar 21 and the stationary contacts 22 must overlap one another somewhere between just bare minimum stationary contact terminal/moving contact overlap, as shown in FIG. 10A, to no more than extending the moving contact 21 beyond the outer boundary of the cylindrical stationary contacts 22 as shown in FIG. 10B. While the configuration of FIG. 10A may be suitable, it does not provide an optimal result as does the configuration of FIG. 10C, wherein the overlap of the moving contact 21 and stationary contacts 22 terminates just slightly beyond the center line of the stationary contacts 22. The moving contact bar 21 may have rounded edges, but such a design is not required.

The reason why the configuration of FIG. 10A is not as optimal as that of FIG. 10C is because in FIG. 10A, the terminal region A of the stationary contact 22 does not come into complete contact with the surface of the moving contact 21. Instead, a gap or spacing will be present which would induce arcing and its associated effects. FIG. 10B is not optimal as there exists too large a portion of the moving contact 21 which extends beyond the terminal region A, as shown. This configuration of FIG. 10B would increase contact cross sectional area and also cause for arcing in the configuration between the contact surfaces that are not in direct contact with one another.

In order to further reduce arcing and welding in the present invention, it is preferable to employ stationary contacts 22 composed of metals such as tungsten or molybdenum which are harder materials, and which have less of a tendency to melt, or puddle thereby creating plasma and arcing during "hot switching" applications.

Figure 11A:
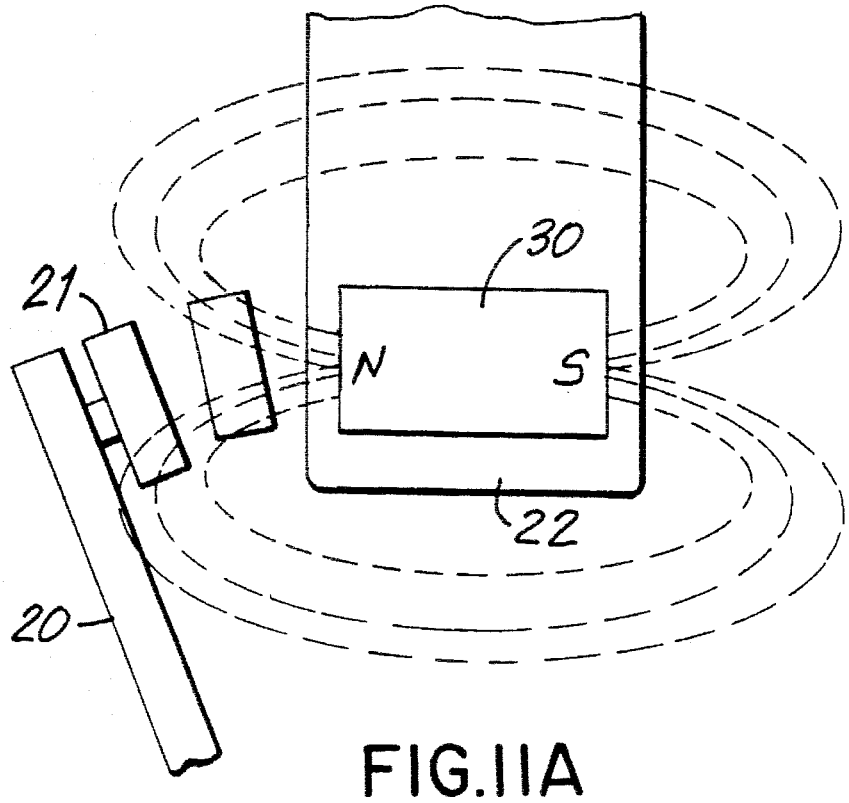
FIGS. 11A and 11B illustrate the use of permanent magnets in the interior of the stationary contacts so as to extinguish arcing and therefore minimize its consequences.

Referring now to FIG. 11A, the stationary contacts 22 and moving contact 21 are illustrated in order to describe another feature of the present invention.

As is well known in the art of DC contractor relay design, the introduction of permanent magnets placed somewhat adjacent to the relay contacts will disrupt the environment surrounding the contacts which serves to extinguish arcing, and therefore, reduce its deteriorative effects. These magnets are preferably of the small, rare earth type and are to be placed right next to, or closely adjacent to the area where arcing can occur. The flux lines for arc disruption are very strong at that point. A further advantage of this technique is that the permanent magnets, being inside the stationary contacts 22, are protected from arcing damage.

Figure 11B:
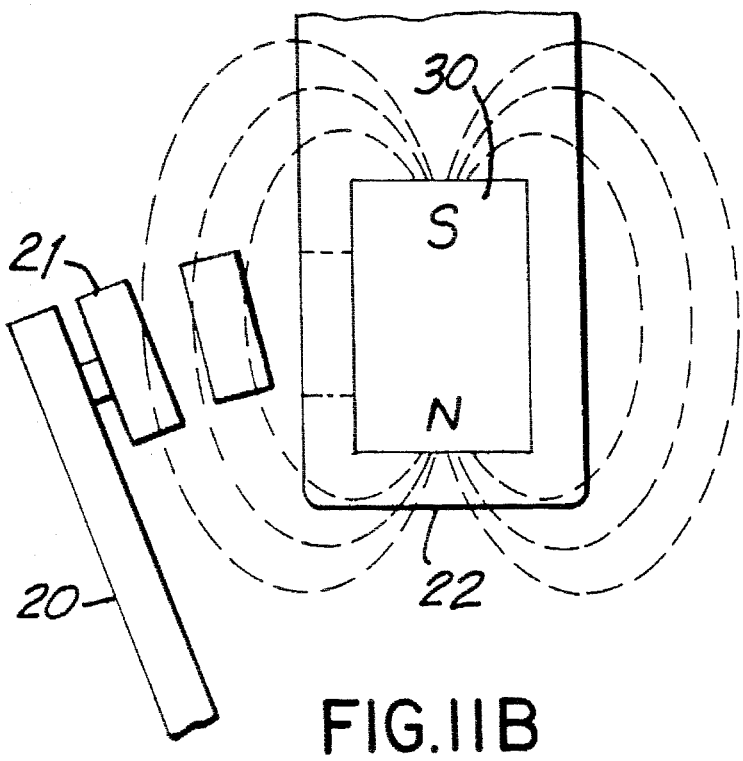

In FIG. 11A permanent magnet 30 is placed inside the stationary contacts 22, in a horizontal orientation with its poles adjacent to the cylinder sides of the stationary contacts 22 as shown. The permanent magnet 30 is horizontally oriented so that one of its poles is adjacent to the terminal region A of the stationary contact 22. With the permanent magnet 30 in place, a magnetic field is generated around the magnet 30 and extends into the gap region between the contacts as shown. While it is optimal to have the flux lines formed as parallel as possible to the moving contact 21 and therefore, perpendicular to the potential arc, such a design would require the vertical placement of the permanent magnet 30 in the stationary contact 22 as shown in FIG. 11B. This placement, however, may not be physically permissible if the magnet site inside the stationary contact 22 does not permit the magnet 30 to be placed vertically therein as is illustrated in FIG. 11B inside the stationary contact 22. With the magnet 30 in place as shown in FIG. 11A, arcing may still be extinguished to a certain degree even though all of the flux lines may not be perpendicular to the potential arc.

It is most important to note at this juncture that placement of the magnet 30 as shown in FIG. 11A, depending on the physical dimensions of the relay it is employed in and the characteristics of the permanent magnet 30 may lead to enhanced arcing if sufficient magnetic flux is not obtained parallel to the moving contact bar 21 and perpendicular to the potential arc. As such the design of FIG. 11A is not recommended but has been made a part of this specification as it may have application in some limited cases.

FIG. 11B as described above illustrates the optimal utilization of permanent magnets 30 within the stationary contacts 22. In FIG. 11B, the magnet 30 is oriented in the vertical direction as shown so that the resultant magnetic flux is perpendicular to the arc between the moving contact 21 and the stationary contacts 22. Potential arcing in the arrangement of FIG. 11B will therefore be more effectively extinguished.

While the present invention has been described in its preferred embodiment, it is to be understood that the above descriptions are merely illustrative of the present invention and not a limitation thereof. Therefore, the present invention covers all modifications, alterations, or variations which fall within the scope and spirit of the principles taught by the present invention.

What is claimed is:

1. A relay, comprising a chamber, stationary contacts mounted in the chamber to be bridged by a movable contact, an electromagnetically driven armature assembly including a rotatable armature pivotable about one end and located in the chamber, a rotatable actuator pivotable about one end and located in the chamber, said rotatable actuator having the moveable contact attached thereto, means for rotating the actuator upon rotation of the armature in a direction to make the stationary contacts, means allowing the armature to continue to rotate after the actuator has ceased to rotate upon the movable contact making the stationary contacts, and impact break means for accelerating the armature from rest prior to breaking the stationary contacts and to thereafter impact against the actuator to rotate the actuator end drive the movable contacts away from the stationary contacts, the rotatable armature having spring receptacle means attached thereto, and a spring positioned between said spring receptacle means and said actuator, said actuator further having stop means contactable against and separatable from said armature.

2. The invention of claim 1, wherein the ends of the rotatable armature and rotatable actuator are pivoted about the same pivot point and axis.

3. The invention of claim 1, further comprising a core assembly and stop means attached to the core assembly for limiting the rotation of the armature.

4. The invention of claim 2, wherein the impact break means comprises a spring acting upon said armature.

5. The invention of claim 1, where said actuator stop means is separated from said armature following making of the stationary contacts by the moveable contact, and wherein said actuator stop means contacts said armature following breaking of the stationary contacts by the moveable contact.

6. The invention of claim 1, wherein said stationary contacts comprise cylinders and said moveable contact comprises a bar for contacting the sides of said cylinders for bridging said stationary contacts.

7. The invention of claim 6, wherein permanent magnets are enclosed within the stationary contacts.

8. The invention of claim 7, wherein each permanent magnet has its poles positioned to create lines of flux predominantly perpendicular to the area between the stationary and moveable contacts where arcing may occur upon making and breaking.

9. The invention of claim 6, wherein the moveable contact bar has a length extending past its lines of contact with the cylindrical stationary contacts but not extending as far as the outer bounds of the cylinders of the stationary contacts.

10. The invention of claim 1, further comprising a core assembly having ferromagnetic members including a core center, a core base, a core exterior structure, and a pole center extending above the core center, non-magnetic separator means surrounding the pole center and extending between the pole center and the core exterior structure, and coils wound about the core center between the core center and the core exterior structure.

11. The invention of claim 1, wherein the stationary contacts are selected from the group consisting essentially of tungsten and molybdenum.

12. The invention of claim 1, wherein the force of the moveable contact is essentially perpendicular to the stationary contacts upon make, and the force on the moveable contact is essentially perpendicular upon break.

13. The invention of claim 1, wherein the chamber is hermetically sealed from the outside atmosphere.

14. The invention of claim 13, wherein the chamber is under vacuum.

15. The invention of claim 1, wherein the relay device is a high voltage/high current DC contactor.

16. The invention of claim 4, wherein the spring is positioned between the armature and the core assembly.

* * * * *